US007859372B2

(12) United States Patent
Ciocirlan et al.

(10) Patent No.: US 7,859,372 B2
(45) Date of Patent: Dec. 28, 2010

(54) METHODS AND APPARATUS FOR REDUCING BOUNCE BETWEEN RELAY CONTACTS

(75) Inventors: Bogdan Octav Ciocirlan, Hummelstown, PA (US); Henry Otto Herrmann, Jr., Elizabethtown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 100 days.

(21) Appl. No.: 11/877,834

(22) Filed: Oct. 24, 2007

(65) Prior Publication Data

US 2009/0107814 A1 Apr. 30, 2009

(51) Int. Cl.
*H01H 51/22* (2006.01)
*H01H 1/36* (2006.01)

(52) U.S. Cl. ..... 335/83; 335/78; 200/252

(58) Field of Classification Search ..... 335/78, 335/83; 200/241, 242, 252, 253, DIG. 42
See application file for complete search history.

(56) References Cited

U.S. PATENT DOCUMENTS 1,189,276 A * 7/1916 Mahoney et al. ..... 218/18
2,421,267 A 5/1947 Huber
2,507,381 A * 5/1950 Morse ..... 200/535
2,671,840 A * 3/1954 Sway ..... 200/241
3,294,932 A * 12/1966 Barlow ..... 200/437
3,624,332 A * 11/1971 Van Benschoten et al. .. 200/409
RE27,406 E * 6/1972 Cork ..... 200/242
4,063,204 A 12/1977 McFarlin
4,216,358 A * 8/1980 Brozille ..... 200/447
4,910,484 A 3/1990 Shikano et al.
5,003,274 A * 3/1991 Chikira et al. ..... 335/83
5,151,675 A * 9/1992 Biehl et al. ..... 335/78
5,969,586 A * 10/1999 Noda et al. ..... 335/83
6,300,854 B1 * 10/2001 Oberndorfer ..... 335/196
6,798,322 B2 9/2004 Copper et al.
7,046,107 B2 * 5/2006 Yamamoto et al. ..... 335/128
2006/0226935 A1 * 10/2006 Kon et al. ..... 335/78

* cited by examiner

*Primary Examiner*—Elvin G Enad
*Assistant Examiner*—Alexander Talpalatskiy

(57) ABSTRACT

A relay assembly includes a coil and a stationary contact having a first contact surface. At least a portion of the first contact surface defines a wiping contact surface. The relay assembly also includes a movable contact having a second contact surface defining a contact area that engages the first contact surface. The movable contact is moved along a driving path toward the stationary contact when current is passed through the coil, and the movable contact is moved along a rebound path different from the driving path after initial impact with the stationary contact. The stationary contact is oriented or shaped with respect to the movable contact such that the movable contact engages, and wipes against, at least a portion of the wiping contact surface when the movable contact is moved along the rebound path.

23 Claims, 3 Drawing Sheets

METHODS AND APPARATUS FOR REDUCING BOUNCE BETWEEN RELAY CONTACTS

BACKGROUND OF THE INVENTION

The subject matter herein relates generally to relay assemblies, and more particularly, to methods and apparatus for reducing bounce during mating of a movable relay contact with a stationary relay contact.

Bouncing of relay and switch button-style contacts is a well known phenomenon, and is typically caused by a combination of factors. The factors include the initial impact and rebound of the contacts, flexing of a beam carrying a movable one of the contacts, the impact between an armature plate carrying the beam and a core of the relay, and/or the propagation of the impacts along the contact beam. Contact bouncing can have the effects of creating electrical noise within the system using the relay or switch and/or damaging the contacts themselves. Bouncing breaks and re-makes the electrical connection at and below the millisecond time-frame. That action generates various stages of arcing causing very broadband noise to be imposed on, and radiated to, connected and surrounding electrical systems. This noise can cause many types of malfunctions and interference. Systems using known relays provide filtering and shielding to diminish the interference or malfunction at an increase in the cost of the overall systems.

Damage to the contacts is generally caused by electrical arcing between the contacts when the contacts are separated from one another, such as during the bouncing of the contacts. Damage to the contacts limits the life and sets the maximum switching energy limits of the device. Many special materials have been developed to withstand the damaging effects long enough to achieve an acceptable service life. Increased contact mass, high velocity action and high forces are needed to enable high switching energy ratings. These limit the size, weight and cost reductions that can be achieved.

Conventional relays address the problems associated with contact bouncing by attempting to reduce the amount of bouncing or by using materials that sustain the wear caused by the arcing. These known relays attempt to reduce the amount of bouncing by using a dampening material on at least one of the contact structures to reduce the rebound after initial impact, by providing a counterweight that impacts the beam or contact at the time of rebound, or by counteracting the rebound with a device, such as a spring to hold the contact against rebound. These solutions are complicated and costly, and do not eliminate the bounce between the contacts. Similarly, the known relays that use materials that sustain wear caused by arcing are costly and the material adds bulk and weight to the contacts. As such, a relay assembly is needed that reduces the bouncing phenomenon in a cost effective and reliable manner.

BRIEF DESCRIPTION OF THE INVENTION

In one embodiment, a relay assembly is provided including a coil and a stationary contact having a first contact surface. At least a portion of the first contact surface defines a wiping contact surface. The relay assembly also includes a movable contact having a second contact surface defining a contact area that engages the first contact surface. The movable contact is moved along a driving path toward the stationary contact when current is passed through the coil, and the movable contact is moved along a rebound path different from the driving path after initial impact with the stationary contact. The stationary contact is oriented or shaped with respect to the movable contact such that the movable contact engages, and wipes against, at least a portion of the wiping contact surface when the movable contact is moved along the rebound path.

Optionally, the first contact surface may be oriented non-coplanar with a plane tangent to an apex of the second contact surface. The wiping contact surface may substantially mirror the rebound path such that the movable contact travels along the wiping contact surface as the movable contact moves along the rebound path. The movable contact may be asymmetrically shaped such that the contact area is off-set with respect to a center of mass of the movable contact. The contact area may be off-set with respect to a center of mass of the movable contact such that the movable contact is rotated along the rebound path after initial impact. Optionally, the relay assembly may include a planar, movable beam, wherein the movable contact is coupled to the beam and moved along the driving path by the beam. The stationary contact may be tilted such that the first contact surface is oriented non-parallel with respect to the plane of the beam when the movable contact initially impacts the stationary contact. The wiping contact surface of the stationary contact may be oriented non-orthogonally with respect to a plane defined by the mounting area. The first contact surface may have a predetermined pitch angle and a predetermined roll angle with respect to a plane of the beam, wherein at least one of the pitch angle and the roll angle are non-zero.

In another embodiment, a relay assembly is provided that includes a stationary contact having a first contact surface that defines a first contact area and a wiping contact surface that extends along the first contact surface from the first contact area. A stationary contact plane is defined tangent to the first contact area, the stationary contact plane extends along a major axis and a minor axis. The relay assembly also includes a movable contact sub-assembly having a movable beam and a movable contact positioned along the beam. The movable contact has a second contact surface defining a second contact area that engages the first contact area when the movable contact is mated with the stationary contact. The movable contact is moved along a driving path by the beam toward the stationary contact, and the movable contact is moved along a rebound path different from the driving path after initial impact with the stationary contact. The stationary contact is tilted about at least one of the major axis and the minor axis such that the movable contact engages the wiping contact surface as the movable contact moves along the rebound path.

In another embodiment, a method is provided of reducing bounce during mating between a movable contact and a stationary contact of a relay assembly. The method includes attaching the movable contact to a movable beam of the relay assembly, such that the movable beam moves the movable contact along a driving path toward the stationary contact. The method also includes orienting or shaping the stationary contact such that the movable contact engages, and wipes against, at least a portion of a wiping contact surface of the stationary contact when the movable contact is moved along a rebound path after initial impact of the movable contact with the stationary contact.

DETAILED DESCRIPTION OF THE INVENTION

Figure 1:
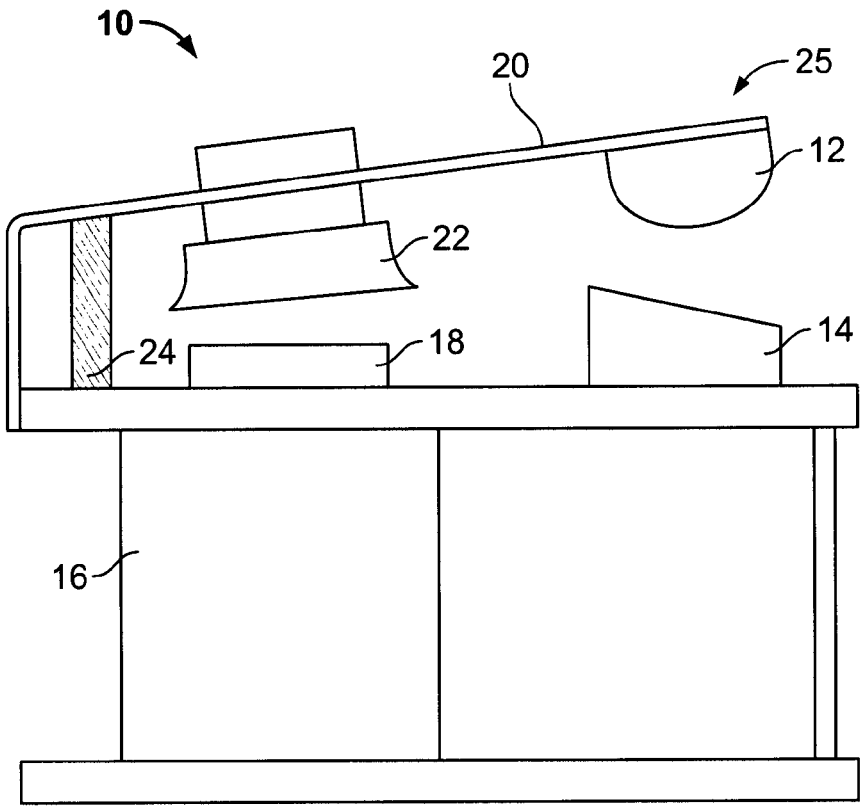
FIG. 1 illustrates an exemplary relay having contacts formed in accordance with an exemplary embodiment.

FIG. 1 illustrates an exemplary relay 10 having a movable contact 12 and a stationary contact 14 formed in accordance with an exemplary embodiment. The relay 10 includes a coil 16 having a core 18. The movable contact 12 is connected to a movable beam 20. The beam 20 also includes an armature 22 connected thereto and aligned with the core 18. Optionally, the beam 20, armature 22 and movable contact 12 may define a movable contact sub-assembly 25 that operate together to drive the movable contact 12 from an open position to a closed position when the coil 16 is energized. For example, the armature 22 is attracted to the core 18 when current is passed through the coil 16. When the armature 22 is attracted to the core 18, the movable contact 12 is driven along a driving path to a closed position, such as the position illustrated in FIG. 2, in which the movable contact 12 engages the stationary contact 14. An electrical circuit is completed when the contacts 12, 14 are in the closed position. A spring 24 is provided to force the beam 20, and thus the movable contact 12, to an open position, such as the position illustrated in FIG. 1.

While the figures illustrate the relay 10, it is realized that the subject matter herein may be applicable to other devices, like switches or other types of relays, that have contacts that are closed to complete an electrical circuit and/or contacts that are susceptible to bouncing. The relay 10 is thus provided as merely illustrative and the subject matter herein is not intended to be limited to the relay 10.

Figure 2:
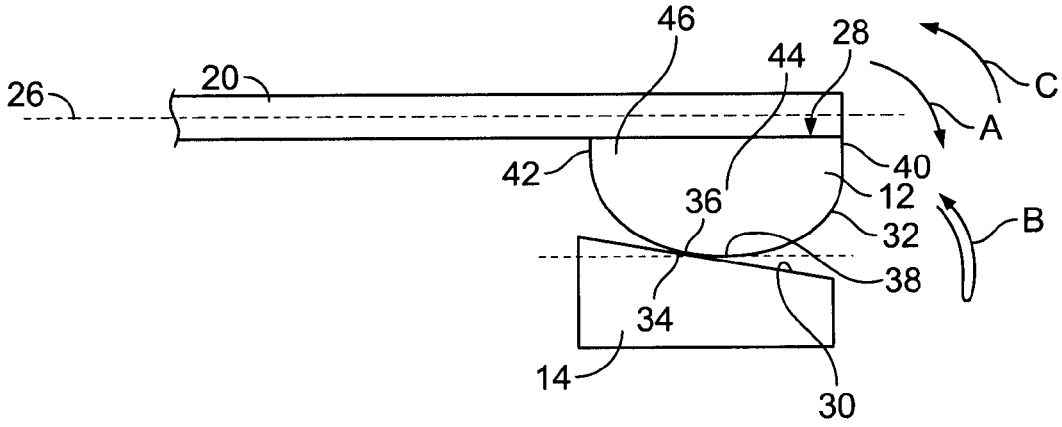
FIG. 2 illustrates the contacts shown in FIG. 1 in a closed condition.

FIG. 2 illustrates the movable contact 12 and the stationary contact 14 in a closed condition. As described above, the movable contact 12 is driven by the beam 20 along a driving path, which is shown generally by arrow A in FIG. 2. The driving path is generally arcuate, as the beam 20 is moved about a hinge point to the closed position. The beam 20 is generally planar and extends along a beam axis 26. A planar mounting area 28 is provided proximate the distal end of the beam 20. The movable contact 12 is mounted to the mounting area 28, but may be integrally formed with the beam 20 in an alternative embodiment. In an exemplary embodiment, the movable contact 12 defines a button contact.

The stationary contact 14 includes a first contact surface 30 oriented to engage a second contact surface 32 of the movable contact 12. When the first and second contact surfaces 30, 32 engage one another, the circuit is completed between the contacts 12, 14. The first and second contact surfaces 30, 32 engage one another at first and second contact areas 34, 36, respectively. The first and second contact areas 34, 36 may each be represented by a point on the respective first and second contact surfaces 30, 32. Alternatively, an area of less than approximately ten percent of the first and second contact surfaces 30, 32 may engage one another to define the first and second contact areas 34, 36, and the first and second contact areas 34, 36 may have a generally circular or oval shape, or another curvilinear or non-curvilinear shape. In other alternative embodiments, an area defining a majority of at least one of the first and second contact surfaces 30, 32 may engage one another to define the first and second contact areas 34, 36.

In the illustrated embodiment, the first contact surface 30 is generally planar, while the second contact surface 32 is generally curved. The shape of the curved surface of the second contact surface 32 is selected to allow the movable contact 12 to maintain contact with the first contact surface 30 at, and immediately following, impact. In the illustrated embodiment, the second contact surface 32 has a convex, or outwardly bulging, curved surface that defines an apex 38 opposite to the beam 20. FIG. 2 illustrates a tangent line that defines a plane tangent to the apex 38, which is shown in phantom. At least a portion of the stationary contact is positioned above the tangent plane of the movable contact 12. Optionally, the apex 38 may be substantially centered along the second contact surface 32, however, the second contact surface may be non-symmetrically shaped, such that the apex 38 is off-set either toward a forward end 40 (e.g. generally toward the distal end of the beam 20) of the movable contact 12 or toward a rearward end 42 of the movable contact 12. In an exemplary embodiment, the second contact area 36 is off-set generally rearward of the apex 38, however, the second contact area 36 may be at the apex 38 or even forward of the apex 38 in alternative embodiments.

In operation, when the relay assembly 10 (shown in FIG. 1) is moved from the normally open position to the closed position, the beam 20 drives the movable contact 12 along the driving path toward the stationary contact 14. Upon initial impact with the stationary contact 14, the movable contact 12 is moved along a rebound path, illustrated in FIG. 2 by arrow B. In the illustrated embodiment, the rebound path is oscillatory and is generally along the driving path and then opposed to the driving path and may oscillate multiple times until coming to rest in the closed position. The movement along the rebound path may be caused by factors such as the impact with the stationary contact, the position of the second contact area 36 on the second contact surface 32, the beam motion along the driving path, impact of the armature 22 (shown in FIG. 1) with the core 18 (shown in FIG. 1), propagation of the impacts of the contacts and/or the armature and core along the beam 20, flexing of the beam 20, the material properties of the contacts and/or the beam, and the like, which may lead to a complex rebound path.

During closing of the contacts 12, 14, the movable contact 12 has a dynamic center of gravity. For example, the above factors may cause the center of gravity of the movable contact 12 to shift, which affects the rebound path. One factor that significantly affects the shifting of the center of gravity and the rebound path is having the position of the contact point (e.g. the first and second contact surfaces 34, 36) off-set with respect to a normal center of gravity 44 of the movable contact. The normal center of gravity of the movable contact 12 is the center of mass of the movable contact 12. In the illustrated embodiment, the normal center of gravity 44 is substantially centered with the movable contact 12, such as at point 44, which may be substantially aligned with the apex 38. During closing, the center of gravity remains generally at the normal center of gravity 44. However, after initial impact, the center of gravity is moved generally rearward, such as to the point 46. The shifting of the center of gravity to point 46 is at least partially caused by the contact point of the contacts 12, 14 being off-set with respect to the center of gravity 44 at initial impact. The force of the beam 20 moving along the driving path also forces the center of gravity to shift, as well as other factors. The shifting of the center of gravity, as well as the inertia of the beam 20 and movable contact 12 induces a rotation of the movable contact 12 about the second contact area 36 along the rebound path. The curved surface of the movable contact 12 facilitates such rotation. The rotation generally causes a wiping motion or scrubbing motion that dissipates the energy of the closing. The scrubbing off of the energy substantially eliminates any separation during the rebound. In an exemplary embodiment, the movable contact 12 oscillates along the rebound path until the movable contact 12 comes to rest in the closed position.

In an exemplary embodiment, the stationary contact 14 is oriented with respect to the movable contact 12 such that the second contact surface 32 engages, and wipes against, at least a portion of the first contact surface 30 as the movable contact 12 is moved along the rebound path. For example, at least a portion of the stationary contact 14 is positioned rearward and upward with respect to the initial contact area 34 such that the movable contact 12 engages the first contact surface 30 as the movable contact 12 is moved along the rebound path. The stationary contact 14 is planar and angled with respect to the movable contact 12 to provide interference with the stationary contact 14 as the movable contact moves along the rebound path. For example, in the illustrated embodiment, the stationary contact 14 is oriented non-parallel to the plane defined by the mounting area 28 such that at least a portion of the stationary contact 12 is positioned above the plane tangent to the apex 38, and the movable contact 12 wipes against the stationary contact 14 as the movable contact is moved along the rebound path. The wiping of the movable contact 12 along the stationary contact 14 may reduce and/or eliminate any bounce or separation of the contacts after the initial impact of the movable contact 12 with the stationary contact 14. Separation of the contacts 12,14 may cause arcing damage to the contacts 12, 14. The amount of time that the contacts are separated, the number of separations that occur, and other factors may have an effect on the amount of damage done to the contacts. Reducing or eliminating such bouncing may prolong the life of the contacts and/or the effectiveness of the contacts. The tilting of the stationary contact, which allows wiping and scrubbing off of energy created during the closing of the contacts, reduces or eliminates bouncing.

In operation, when the relay assembly 10 (shown in FIG. 1) is moved from the closed position, such as the position shown in FIG. 2, to the open position, the beam 20 drives the movable contact 12 along an opening path, represented in FIG. 2 by the arrow C, generally away from the stationary contact 14. The opening path may be generally opposite to the driving path. In an exemplary embodiment, the opening path is different than the rebound path.

Figure 3:
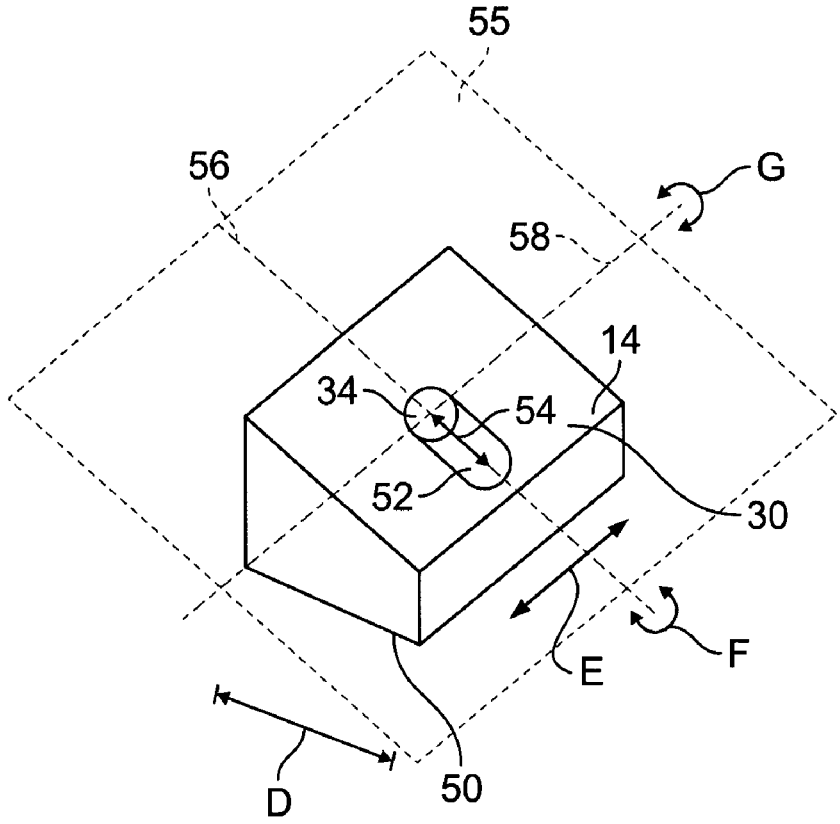
FIG. 3 illustrates a stationary one of the contacts shown in FIG. 1.

FIG. 3 illustrates the stationary contact 14. In an exemplary embodiment, the first contact surface 30 of the stationary contact 14 is planar and non-parallel with respect to a base 50 of the stationary contact 14. However, the first contact surface 30 may be parallel to the base 50 in alternative embodiments. The first contact surface 30 defines the first contact area 34, which is represented schematically in FIG. 3. The first contact area 34 is the portion of the first contact surface 30 that the movable contact 12 (shown in FIGS. 1 and 2) engages upon initial impact and may also define the area in which the movable contact 12 engages the stationary contact 14 when the contacts 12, 14 are in the closed position. The size of the first contact area 34 depends upon the size and shape of the movable contact 12. Optionally, the first contact area 34 may be a point.

The first contact surface 30 also defines a wiping contact surface 52, which is a portion of the first contact surface 30 upon which the movable contact wipes against as the movable contact 12 is transferred along the rebound path. The wiping contact surface 52 extends along a wiping path 54 that may be either linear (such as shown in FIG. 3) or non-linear. The wiping contact surface 52 may also be discontinuous, such that multiple wiping contact surfaces 52 are defined on the first contact surface 30. The orientation of the wiping contact surface 52 depends on the rebound path of the movable contact 12, the shape and position of the stationary contact 14 with respect to the movable contact 12, and the like.

In an exemplary embodiment, the stationary contact 14 includes a stationary contact plane 55 that is tangent to the first contact area 34. The stationary contact plane 55 is defined by both a major axis 56 and a minor axis 58. The major axis 56 extends through the first contact area 34 and is oriented generally parallel to the beam axis 26 (shown in FIG. 2). The minor axis 58 also extends through the first contact area 34 and is oriented generally perpendicular with respect to the major axis 56. As described above, the stationary contact 14 is oriented within the relay assembly 10 (shown in FIG. 1) such that the movable contact 12 engages the first contact surface 30 of the stationary contact 14 as the movable contact 12 moves along the rebound path. The orientation of the stationary contact 14 may be adjusted or set by either translating or tilting the stationary contact 14. For example, the stationary contact 14 may be translated along at least one of the major axis 56 and/or the minor 58 to position the stationary contact 14 for contact with the movable contact 12, which is shown by arrows D and E, respectively. Additionally, the stationary contact 14 may be tilted by either pitching or rolling the stationary contact 14 in one direction or another. For example, rotating the stationary contact 14 about the major axis 56, shown by arrow F, may adjust the roll angle and rotating the stationary contact 14 about the minor axis 58, shown by arrow G, may adjust the pitch angle.

In an exemplary embodiment, and as illustrated in FIG. 2, the stationary contact 14 is tilted about the minor axis 58, such that the stationary contact 14 has a positive pitch angle, but is not tilted about the major axis 56, such that the stationary contact 14 has a zero roll angle. The positive pitch angle provides at least a portion of the first contact surface 30 above (e.g. generally in the direction of the beam 20) the first contact area 34, wherein the movable contact 12 is lowered onto the stationary contact 14 from above. As such, at least a portion of the stationary contact 14 is positioned to interfere with the movable contact 12 along the rebound path such that when the movable contact 12 travels along the rebound path, the movable contact 12 engages, and moves along (e.g. wipes against) the wiping contact surface 52 of the stationary contact 14.

In an alternative embodiment, the stationary contact 14 is tilted about the major axis 56, such that the stationary contact 14 has either a positive or negative roll angle. The stationary contact 14 may be rolled in addition to, or in lieu of, being pitched. The roll angle provides at least a portion of the first contact surface 30 above the first contact area 34, such that the movable contact 12 engages, and moves along, the wiping contact surface 52 of the stationary contact 14. In another alternative embodiment, the stationary contact 14 may be provided with a negative pitch angle. In such an embodiment, the initial contact area on the stationary contact 14 may be located forward of a final contact area, such that the movable contact is wiped along the wiping contact surface 52 from the initial contact area to the final, closed position of the contacts 12, 14. Such an embodiment may reduce bouncing by reducing the initial impact of the movable contact 12 and the stationary contact 14 by allowing the movable contact 12 to continue generally along the driving path in a downward and rearward direction.

Figure 4:
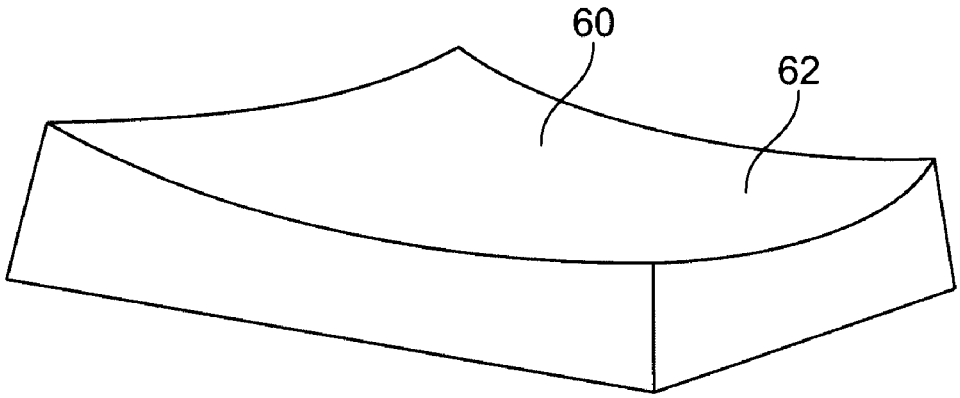
FIG. 4 illustrates an alternative stationary contact formed in accordance with an alternative embodiment.

FIG. 4 illustrates an alternative stationary contact 60 formed in accordance with an alternative embodiment. The stationary contact 60 has a non-planar first contact surface 62. In the illustrated embodiment, the first contact surface 62 of the stationary contact 60 is generally concave and has a shape similar to a determined rebound path of a corresponding movable contact.

In other alternative embodiments, stationary contacts having other non-planar first contact surfaces. The shape may be complex to accommodate a complex rebound path of a corresponding movable contact.

Figure 5:
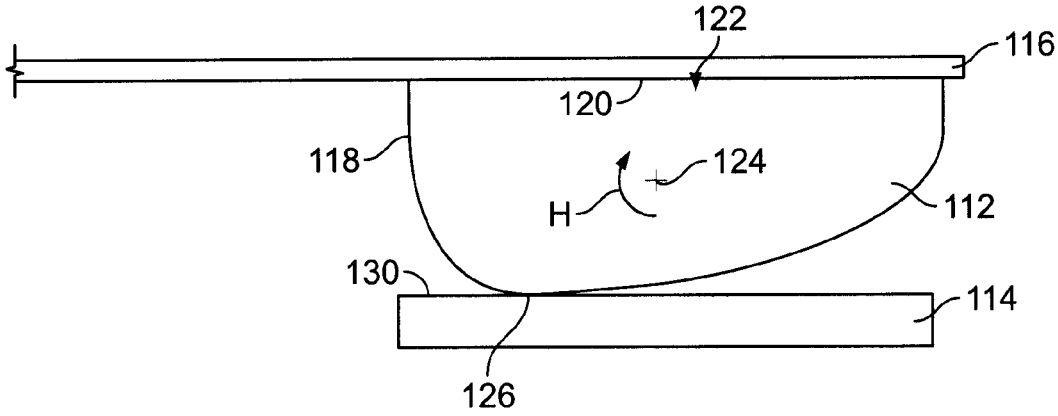
FIG. 5 illustrates an alternative movable one of the contacts engaging a stationary one of the contacts.
Figure 6:
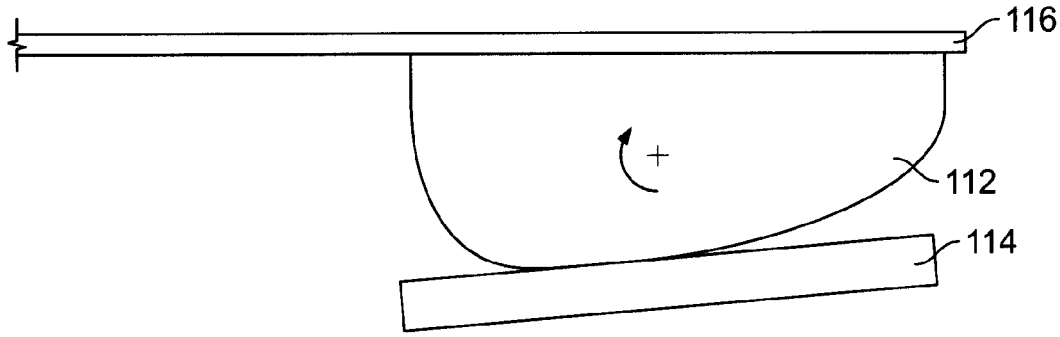
FIG. 6 illustrates the stationary contact shown in FIG. 5 in a different orientation with respect to the movable contact.

FIG. 5 illustrates an alternative movable contact 112 engaging a stationary contact 114. FIG. 6 illustrates the stationary contact 114 in a different orientation with respect to the movable contact 112. The contacts 112, 114 may be arranged within a relay similar to the relay 10 and the movable contact 112 may be moved similarly to the contact 12 described above. The movable contact 112 is connected to a movable beam 116. The movable contact 112 has a contact surface 118 along an outer portion thereof and is attached to the beam along a mounting surface 120. The movable contact 112 is shaped asymmetrically. The movable contact 112 may have any shape, but in the illustrated embodiment, the movable contact 112 has a maximum width from the mounting surface 120 at a portion of the contact surface 120 that is not aligned with a midpoint 122 of the mounting surface 120. For example, the maximum width is located rearward of the midpoint 122 in the illustrated embodiment. Such a configuration provides an irregularly shaped movable contact 114. The asymmetric shape of the movable contact 112 causes a center of mass 124 of the movable contact 112 to be off-set with respect to the midpoint as well.

In an exemplary embodiment, the shape of the movable contact 112 dictates a contact area 126 of the movable contact 112. For example, the contact area 126 (or contact point in some embodiments depending on the shape and material of the contacts) may be proximate the portion of the movable contact 112 having a maximum width. The contact area 126 is generally off-set with respect to the center of mass 124, which creates an eccentric impact between the movable contact 112 and the stationary contact 114. For example, the off-set causes the movable contact to rotate or roll about the center of mass after initial impact, which is generally shown by arrow H. The eccentric movement causes a scrubbing or wiping between the contacts 112, 114 which reduces or eliminates any bounce between the contacts 112, 114.

In an exemplary embodiment, such as illustrated in FIG. 5, the stationary contact 114 may be oriented such that a contact surface 130 of the stationary contact 114 is generally parallel with the beam 116. Alternatively, the stationary contact may be tilted such that the plane of the stationary contact 114 is non-parallel with a plane of the beam 116, such as illustrated in FIG. 6. The tilt may be about the major and/or minor axis of the stationary contact 114.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A relay assembly comprising:

a coil; a movable beam supporting a movable contact having a movable contact surface; and a stationary contact having a first contact surface inclined with respect to the movable contact surface; the movable contact having a second contact surface defining a contact area that engages the first contact surface, the second contact surface being a convex curved surface having an apex the movable contact being asymmetrically shaped such that the contact area and the apex are off-set with respect to a center of mass of the movable contact, the contact area being off-set with respect to the apex, the movable contact is moved along a driving path toward the stationary contact when current is passed through the coil, and the movable contact is moved along a wiping path different from the driving path after initial impact with the stationary contact;

wherein at least a portion of the first contact surface defines a wiping contact surface, the stationary contact is oriented or shaped with respect to the movable contact such that impact energy of the movable contact is converted into rotational movement of the movable contact that is matched to a surface contour of the stationary contact to ensure that the movable contact engages, and wipes against, at least a portion of the wiping contact surface without separation from the stationary contact when the movable contact is moved along the wiping path.

2. The relay assembly of claim 1, wherein the first contact surface is oriented non-coplanar with a plane tangent to an apex of the second contact surface when the movable contact engages the stationary contact.

3. The relay assembly of claim 1, wherein the contact area is off-set with respect to the center of mass of the movable contact such that the movable contact is rotated along the wiping path after initial impact.

4. The relay assembly of claim 1, wherein the wiping contact surface substantially mirrors the wiping path such that the movable contact travels along the wiping contact surface as the movable contact moves along the wiping path.

5. The relay assembly of claim 1, wherein the stationary contact is tilted such that the first contact surface is oriented non-parallel with respect to a plane of the beam when the movable contact initially impacts the stationary contact.

6. The relay assembly of claim 1, wherein the beam has a planar mounting area, the movable contact is coupled to the mounting area and is moved along the driving path by the beam, wherein the wiping contact surface of the stationary contact is oriented non-orthogonally with respect to a plane defined by the mounting area.

7. The relay assembly of claim 1, wherein a stationary contact plane is defined tangent to the first contact surface, the stationary contact plane extends along a major axis and a minor axis, wherein the stationary contact is tilted about at least one of the major axis and the minor axis such that the movable contact engages the wiping contact surface as the movable contact moves along the rebound wiping path.

8. The relay assembly of claim 7, wherein the major axis is substantially aligned with a beam carrying the movable contact, and tilting the stationary contact about the minor axis angles the major axis toward or away from the beam.

9. The relay assembly of claim 1, wherein the second contact surface of the movable contact is convex in shape, the contact area extending along the curved second contact surface such that the contact area is non-planar, and wherein the stationary contact is tilted such that different portions of the contact area wipe along the first contact surface as the movable contact is moved along the wiping path.

10. A relay assembly comprising:

a stationary contact having a first contact surface that defines a first contact area and a wiping contact surface that extends along the first contact surface from the first contact area; and a movable contact sub-assembly having a movable beam and a movable contact positioned along the beam, the movable contact having a mounting surface mounted to the beam and a second contact surface opposite the mounting surface, the second contact surface defining a second contact area that engages the first contact area when the movable contact is mated with the stationary contact, the second contact surface being a convex curved surface having a maximum width measured from the second mounting surface at a portion of the contact surface offset from a midpoint of the mounting surface, the movable contact being asymmetrically shaped such that the second contact area and the portion of the curved surface having the maximum width are off-set with respect to a center of mass of the movable contact, wherein the movable contact is moved along a driving path by the beam toward the stationary contact, and the movable contact is moved along a wiping path different from the driving path after initial impact with the stationary contact; wherein a stationary contact plane is defined tangent to the first contact surface, the stationary contact plane being inclined with respect to the second contact surface; and wherein the movable contact engages the wiping contact surface so that a rotationally induced wiping action is induced as the movable contact moves along the wiping path.

11. The relay assembly of claim 10, wherein the movable contact is at least one of oriented and shaped such that the second contact area is off-set with respect to a center of mass of the movable contact such that the movable contact is rotated along the wiping path after initial impact.

12. The relay assembly of claim 10, wherein the first contact surface is generally planar and tilted such that the first contact surface is oriented in a non-coplanar relation with a plane tangent to an apex of the movable contact.

13. The relay assembly of claim 10, wherein the beam lowers the movable contact toward the stationary contact from above along the driving path, and wherein at least a portion of the stationary contact is above the first contact area of the stationary contact such that the stationary contact extends generally toward the beam from the first contact area.

14. The relay assembly of claim 10, wherein the stationary contact is tilted to a predetermined pitch angle and a predetermined roll angle with respect to a plane of the beam, wherein at least one of the pitch angle and the roll angle are non-zero.

15. The relay assembly of claim 1, wherein at least one of the first contact surface and the second contact surface is non-planar.

16. The relay assembly of claim 1, wherein at least a portion of the first contact surface is positioned outward of the contact area in a direction generally opposite to the direction of the driving path.

17. The relay assembly of claim 1, wherein the contact area moves along the wiping contact surface as the movable contact moves along the wiping path from the time of initial impact with the stationary contact until the movable contact comes to rest in engagement with the stationary contact.

18. The relay assembly of claim 1, wherein the first contact surface has a predetermined pitch angle and a predetermined roll angle with respect to a plane of the beam, wherein both of the pitch angle and the roll angle are non-zero.

19. The relay assembly of claim 1, wherein the stationary contact is angled non-orthogonal with respect to a plane parallel to a tangent of the contact area of the movable contact such that at least a portion of the stationary contact is positioned above the plane parallel to a tangent of the contact area and at least a portion of the stationary contact is positioned below the plane parallel to a tangent of the contact area.

20. The relay assembly of claim 1, wherein the coil is operated at a current configured to supply greater than 14 volts.

21. The relay assembly of claim 1, wherein at least one of the first contact surface and the second contact surface are nonplanar at the entire surface thereof making physical contact with the other of the stationary or movable contact.

22. The relay assembly of claim 1, wherein the stationary contact has a contour shape that matches the movement path of the contact area of the movable contact as the movable contact is moved along the wiping path such that the portion of the second contact surface defining the contact area remains engaged to, and wipes along, the wiping contact surface of the stationary contact.

23. The relay assembly of claim 10, the stationary contact plane extending along a major axis and a minor axis, and wherein the movable contact includes a movable contact plane defined tangent to the second contact area, the stationary contact plane being oriented at a compound angle relative to the movable contact plane, the compound angle being formed by the stationary contact being tilted about the major axis and the minor axis.

* * * * *